US006686797B1

(12) United States Patent
Eker

(10) Patent No.: US 6,686,797 B1
(45) **Date of Patent: *Feb. 3, 2004**

(54) TEMPERATURE STABLE CMOS DEVICE

(75) Inventor: Mehmet M. Eker, Santee, CA (US)

(73) Assignee: Applied Micro Circuits Corporation, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/238,245

(22) Filed: Sep. 9, 2002

Related U.S. Application Data

(63) Continuation of application No. 09/708,761, filed on Nov. 8, 2000, now Pat. No. 6,466,081.

(51) Int. Cl.[7] ..... G05F 1/10

(52) U.S. Cl. ..... 327/539; 327/541; 323/313; 323/316

(58) Field of Search ..... 327/539, 540, 327/541, 573; 323/313, 316

(56) References Cited

U.S. PATENT DOCUMENTS

| | | | | |
|---|---|---|---|---|
| 4,628,248 A | | 12/1986 | Birrittella et al. | |
| 4,656,415 A | | 4/1987 | Draxelmayr | |
| 4,742,292 A | | 5/1988 | Hoffman | |
| 4,912,347 A | | 3/1990 | Morris | |
| 4,937,469 A | | 6/1990 | Larson et al. | |
| 5,047,707 A | | 9/1991 | Dixon et al. | |
| 5,194,762 A | | 3/1993 | Hara et al. | |
| 5,384,740 A | | 1/1995 | Etoh et al. | |
| 5,495,184 A | | 2/1996 | Des Rosiers et al. | |
| 5,519,310 A | * | 5/1996 | Bartlett | 323/316 |
| 5,625,281 A | * | 4/1997 | Lambert | 323/315 |
| 5,680,037 A | | 10/1997 | Carobolante | |
| 5,757,224 A | | 5/1998 | Antone et al. | |
| 5,796,244 A | | 8/1998 | Chen et al. | |
| 5,883,798 A | | 3/1999 | Yamaguchi | |
| 5,900,773 A | * | 5/1999 | Susak | 327/539 |
| 6,002,245 A | | 12/1999 | Sauer | |
| 6,023,189 A | | 2/2000 | Seelbach | |
| 6,087,820 A | | 7/2000 | Houghton | |
| 6,166,587 A | * | 12/2000 | Burzio et al. | 327/538 |
| 6,466,081 B1 | | 10/2002 | Eker | |
| 6,529,066 B1 | * | 3/2003 | Guenot et al. | 327/539 |

OTHER PUBLICATIONS

Author Unknown, "CMOS Temperature Sensors and Bandgap Voltage References", http://www.stw.nl/projecten/D/del3532.html, (3 pgs.) 9/00.

Baker, Anton, Summary of "Thesis: High–Accuracy CMOS Smart Temperature Sensors", http://wwwetis.et.tudelft.nl/~anton/summary.pdf, pp. 119–122, 3/00.

* cited by examiner

*Primary Examiner*—Terry D. Cunningham
(74) *Attorney, Agent, or Firm*—INCAPLAW; Terrance A. Meador

(57) ABSTRACT

A CMOS field effect transistor (FET) is provided with predetermined temperature characteristics. More particularly, the relationship between the channel length, gate width, gate-to-source voltage, and drain current is exploited to create an FET that has relatively constant drain current across a relatively wide range of frequencies. Alternately, the above-mentioned relationship is exploited to create a drain current with a predetermined temperature coefficient across a wide temperature range.

2 Claims, 3 Drawing Sheets

TEMPERATURE STABLE CMOS DEVICE

This is a continuation of Ser. No. 09/708761, filed Nov. 8, 2000, now U.S. Pat. No. 6,466,081.

BACKGROUND OF THE INVENTION

1. Field of the Invention

This invention relates generally to CMOS design and, more particularly, to a temperature stable CMOS device and temperature stable bias circuit, made using the above-mentioned temperature stable CMOS device.

2. Description of the Related Art

CMOS field effect transistors (FETs), as well as many other active silicon devices, as used as elements in temperature compensation circuitry. One such circuitry supplies a bias voltage that remains constant, independent of supply voltage and temperature changes. However, it is well known that FET devices have varying temperature characteristics. Therefore, compensation circuitry must be added to cancel out the temperature variations in the active components.

In general, a positive temperature coefficient is produced by using two transistors operated at different current densities as is well understood. When bipolar active devices are used, a resistor is connected in series with the emitter of the transistor that is operated at a smaller current density. Then, the base of this transistor and the other end of the resistor are coupled across the base and emitter of the transistor operated at the higher current density to produce a delta $V_{BE}$ voltage across the resistor that has a positive temperature coefficient. This positive temperature coefficient voltage is combined in series with the $V_{BE}$ of a third transistor which has a negative temperature coefficient in a manner to produce a composite voltage having a very low or zero temperature coefficient.

Such prior art voltage reference circuits are generally referred to as bandgap voltage references because the composite voltage is nearly equal to the bandgap voltage of silicon semiconductor material, i.e., approximately 1.2 volts. Typically, the two transistors of the bandgap cell are NPN devices with the first transistor having an emitter area that is ratioed with respect to the emitter area of the second transistor, whereby the difference in the current density is established by maintaining the collector currents of the two transistors equal.

Bandgap stages and bandgap circuits are conventional and are described, for instance, in the book entitled, "Halbleiter-Schaltungstechnik" (Semiconductor-Circuit Technique) by U. Tietze and Ch. Schenk, $5^{th}$ revised edition, Springer Verlag, Berlin, Heidelberg, New York 1980. Using bandgap circuits, reference voltages can be generated which are independent of the temperature coefficients of the components used therein. In other words, such a circuit supplies a temperature independent reference voltage. However, these considerations are only valid for first-order temperature dependencies in a relatively narrow temperature range. In practice, a voltage-temperature curve is only straight or independent of temperature in a narrow temperature range. Actually, such circuits still have a temperature dependency, which may have a parabolic shape with a change of about 1% in a temperature range from −55° C. to +125° C., according to an article in "IEEE Journal of Solid-State Circuits", Vol. SC 15, No. 6, December 1980, Pages 1033 to 1039.

For certain applications, such as in fast digital-analog converters or analog-digital converters, the above-mentioned temperature dependency may still have a disturbing effect due to higher order temperature effects, so that the reference voltage generated by the bandgap circuit is not sufficiently independent of temperature. Measures for the temperature compensation of temperature dependencies of higher order, particularly second order, have already become known, for instance, from the above-mentioned journal "IEEE Journal of State-Solid Circuits". In principle, these are circuitry measures, through which a current is fed to a bandgap circuit, the current having a temperature dependency compensating the temperature dependency of the band gap circuit.

It would be advantageous if a CMOS FET could be fabricated with predetermined temperature characteristics over a relatively wide range of temperatures.

It would be advantageous if a CMOS FET could be fabricated with a constant drain current and constant gate-to-source voltage over a wide range of temperatures.

It would be advantageous if a CMOS FET with predetermined temperature characteristics could be used in a bias voltage circuit to provide a bias voltage with a predetermined temperature coefficient over a wide range of temperatures.

SUMMARY OF THE INVENTION

Accordingly, a bias circuit is provided which is independent of temperature and power supply variations, even when low power supply voltages are used. The bias circuit generates a reference current that is scaled by a resistance. When the resistance is used as a load in a differential pair biased by this current, the swing at the output of the differential pair can be made constant, even if the nominal value of the resistor changes over temperature.

More specifically, a FET with predetermined temperature characteristics is used in the bias circuit. The FET has a first gate width (W) and a first channel region having a first channel length (L) that are selected to provide a predetermined drain current ($I_D$) and gate-to-source voltage ($V_{gs}$) in a first temperature range.

In one aspect of the invention, the load resistor has a temperature coefficient of zero, and the predetermined drain current remains approximately constant across the first temperature range. The channel length and the gate width are selected so that their effects create a drain current with a zero temperature coefficient across a relatively wide range of temperatures. Alternately, the load resistance has a predetermined, non-zero, temperature coefficient. Then, the channel length and the gate width are selected so that their effects create a drain current temperature coefficient which corresponds to the load resistance coefficient, so that a constant bias voltage can be maintained.

Specifics of the FET fabrication, bias circuit design, and methods of generating a predetermined bias voltage and FET with predetermined temperature characteristics are provided in the detailed description of the invention below.

DETAILED DESCRIPTION OF THE PREFERRED EMBODIMENTS

Figure 1:
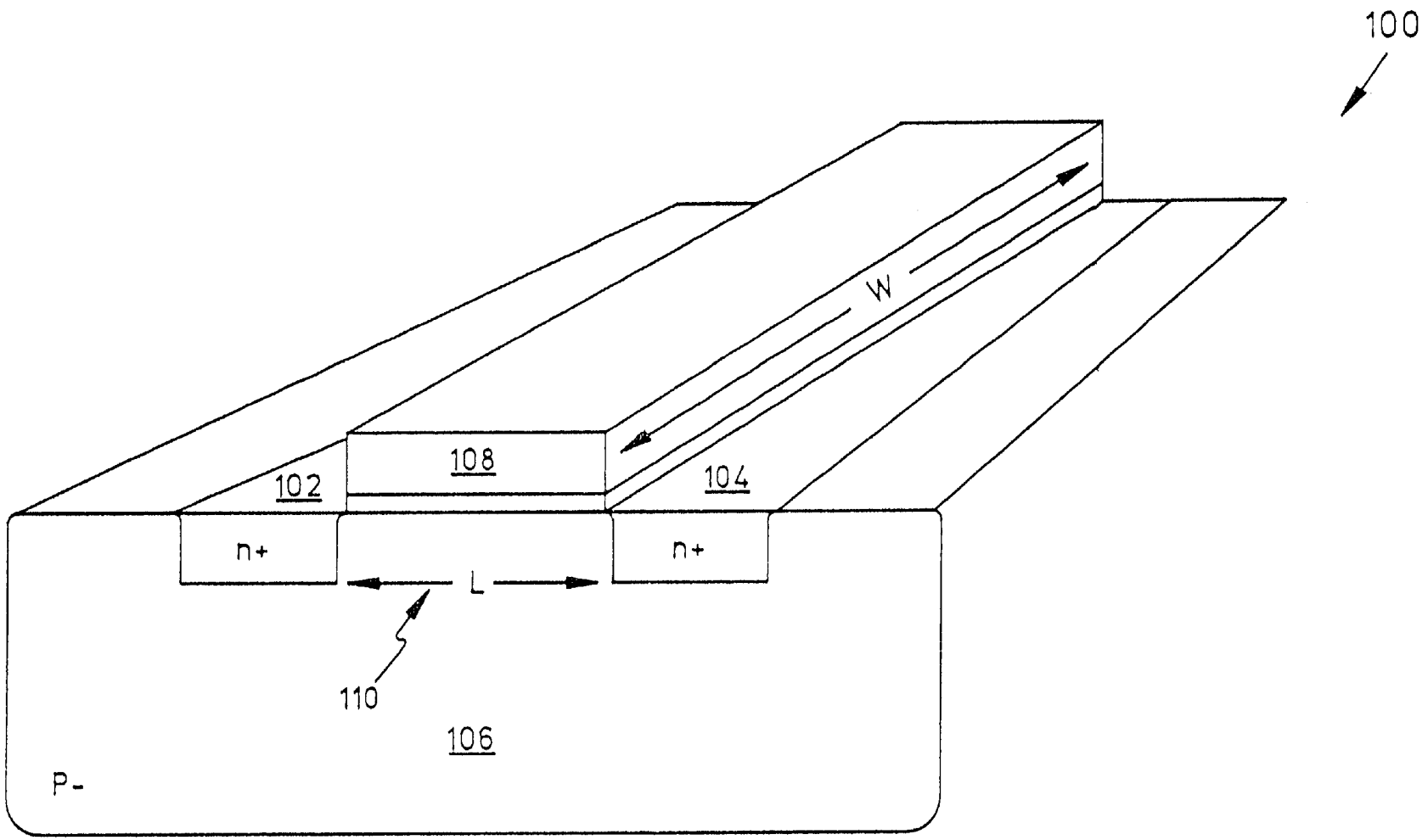
FIG. 1 is a perspective drawing of a CMOS FET of the present invention having predetermined temperature characteristics.

FIG. 1 is a perspective drawing of a CMOS FET of the present invention having predetermined temperature characteristics. The FET 100 includes a source 102 and a drain 104. The source 102 and drain regions are shown as n+ doped regions in a p− substrate 106. The doping is merely exemplary of an N-channel, and many other doping schemes are possible. Although the present invention is shown as an N-channel device, it can also be embodied in a P-channel configuration, as would be well known by those skilled in the art.

A gate region 108, having a first gate width (W), is also shown. A first channel region 110, having a first channel length (L), underlies the gate 108, between the source 102 and drain 104. The first channel length (L) and the first gate width (W) are selected to provide a predetermined drain current ($I_D$) and a gate-to-source voltage ($V_{gs}$) in a first temperature range.

Long channel device current expressions will be used, below, for simplicity. However, the findings are equally applicable to the short channel devices. The quadratic current expression for a long channel device is given as:

$$I_D = \frac{\mu_e C_{\alpha x} W}{2l} \cdot (V_{gs} - V_{th})^2 \qquad \text{Equation (1)}$$

After re-arranging the above expression for $V_{gs}$ $$V_{gs} = \sqrt{\frac{2 I_D L}{\mu_e C_{\alpha\chi} W}} + V_{th} \qquad \text{Equation (2)}$$

The present invention defines a condition where the current $I_D$ is constant over temperature, or has a predetermined (desirable) temperature coefficient. In the above expression for vgs then, $I_D$ and vgs are constant over temperature. The only other terms that change with temperature in the expression are $V_{th}$ and $\mu_e$. They both have negative temperature coefficients. Fortunately, since $\mu_e$ is in the denominator, its negative temperature coefficient becomes positive for vgs, which permits the negative temperature coefficient of $V_{th}$ to be cancelled.

The temperature effects on $V_{th}$ and $\mu_e$ for the BSIM3v3.1 MOSFET (SPICE) model can be given, for first order, as:

$$V_{th}(T) = V_{th}(T_{nom}) + \left(K_{T1} + \frac{K_{t11}}{L_{eff}} + K_{T2} \cdot V_{bsef} f\right) \cdot \left(\frac{T}{T_{nom}} - 1\right) \qquad (3)$$

And $$\mu_0(T) = \mu_0(T_{nom}) \cdot \left(\frac{T}{T_{nom}}\right)^{\mu_{te}} \qquad (4)$$

Where $T_{nom}$ is the temperature at which the device parameters are extracted (in degrees Kelvin). If the parameters were extracted, for example, at 25° C., then $T_{nom}$ would be 273.15+25=298.15° K.

$K_{T1}$ is the temperature coefficient for the threshold voltage, $K_{T2}$, is the body-bias coefficient of the threshold temperature effect, $K_{t11}$, is the channel length dependence of the temperature coefficient for the threshold voltage. $\mu_{te}$ is the mobility temperature exponent. Typical, these coefficients are negative values. Therefore, both $V_{th}$ and $\mu_e$ decrease with increasing temperature. The relationship between $\mu_e$ and $\mu_0$ can be given as $\mu_e = C_{0\mu 0}$. Here $C_0$ is a bias and temperature dependent coefficient. The temperature effects of $C_0$ can be ignored for first order analysis, as they are minor.

If the temperature dependent terms in Equation (2) are combined, then:

$$V_{gs} = V_{th}(T_{nom}) + \alpha_{th}\left(\frac{T}{T_{nom}} - 1\right) + \sqrt{\frac{2 \cdot I_D \cdot L}{C_0 \mu_0(T_{nom}) C_{\alpha\chi} W}} \cdot \left(\frac{T}{T_{nom}}\right)^{-\frac{\mu te}{2}} \qquad (5)$$

$$\alpha_{th} = K_{t1} + \frac{K_{t11}}{L_{eff}} + K_{T2} \cdot V_{bseff} \qquad (6)$$

As it can be seen, the temperature dependency of the last term in (5) changes direction. That is, the second term in (5) will still decrease with increasing temperature (as $\alpha_{th}$ is negative), whereas the third term in (5) increases with increasing temperature (as $\mu_{te}$ is also negative). Thus, there is a condition where these terms will cancel each other out. In general, these terms will cancel out at a given temperature. However, if this temperature is selected to be approximately in the middle of the temperature range of interest, very good stability can be maintained over that temperature range. The condition for such temperature stability can be derived by taking the temperature derivative of (5) at the approximate middle, or first temperature, $T_{1st}$.

$$\left.\frac{\partial V_{gs}}{\partial T}\right|_{T=Tmid} = \frac{\alpha_{th}}{T_{nom}} - \frac{B \cdot \mu_{te}}{2 T_{nom}} \cdot \sqrt{\frac{2 I_D L}{C_0 \mu_0(T_{nom}) C_{\alpha\chi} W}} = 0 \qquad (7)$$

Where $$B = \left(\frac{T_{nom}}{T_{mid}}\right)^{1+\frac{\mu te}{2}}$$

Therefore, the condition for the temperature stability at $T_{1st}$ reduces to:

$$\alpha_{th} = \frac{B \cdot \mu_{te}}{2} \cdot \sqrt{\frac{2 I_D L}{C_0 \mu_0(T_{nom}) C_{\alpha\chi} W}} \qquad \text{Equation (8)}$$

Properly biasing and sizing the transistor can achieve this condition. Further, good temperature stability can be achieved over wide temperature ranges. In some aspects of the invention a first temperature of 65 degrees C. and a temperature range from −40° to 130° C. are used.

Alternately, FET 100 can be fabricated to have predetermined gate-to-source temperature coefficients. Then, the channel length and the gate width are selected so that their effects create the desired gate-to-source temperature coefficient. A use for FETs having predetermined temperature characteristics is explained below.

Figure 2:
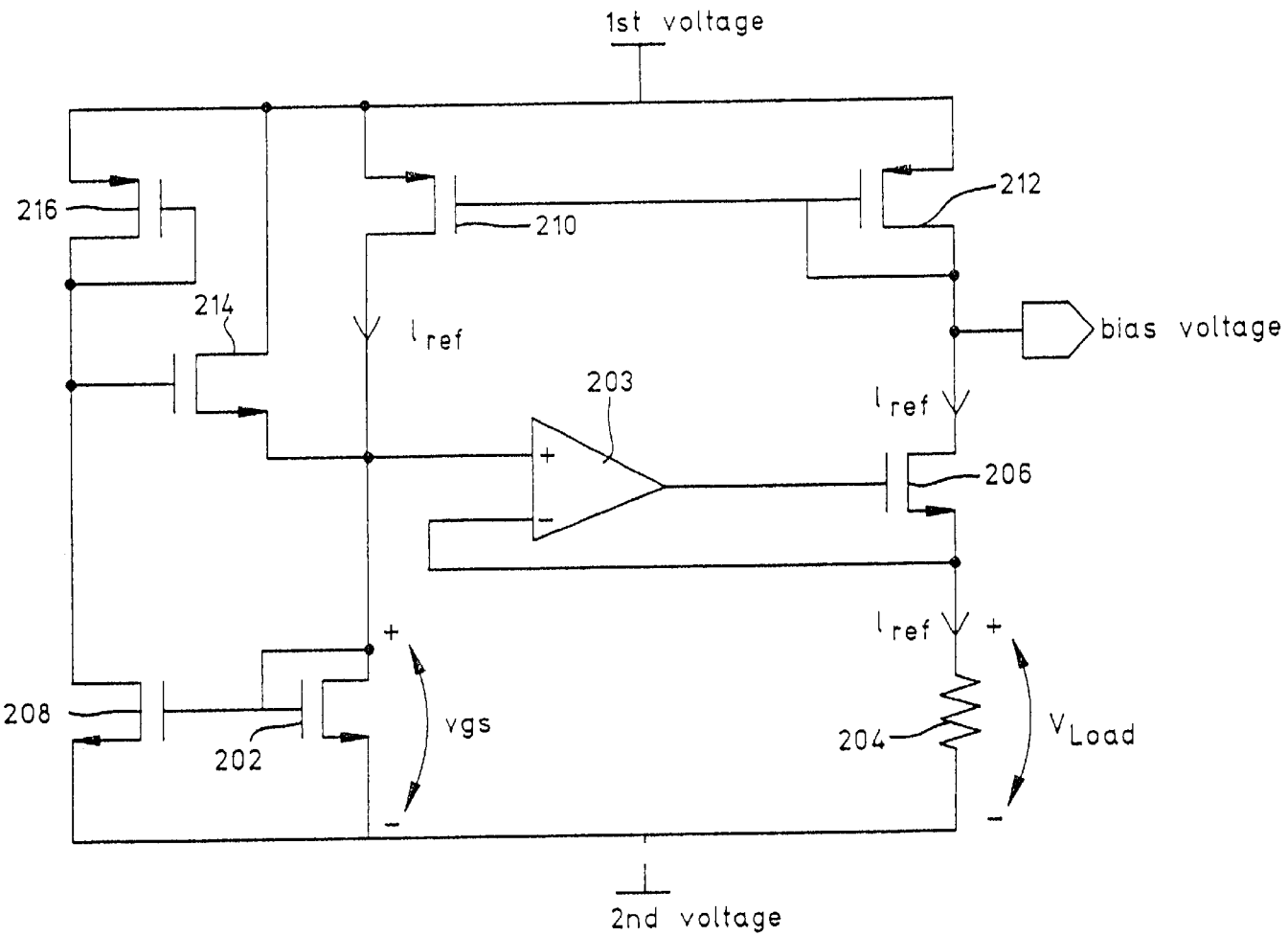
FIG. 2 is a schematic block diagram illustrating the present invention temperature stable bias circuit.

FIG. 2 is a schematic block diagram illustrating the present invention temperature stable bias circuit 200. A reference voltage (vgs) is used in a feedback system to generate a bias voltage that is independent of supply voltage. The bias circuit 200 also supplies a reference current ($I_{ref}$) that is stable over temperature. The bias circuit can also be designed to track predetermined changes in the load voltage ($V_{load}$), so that the signal swing is kept more or less constant.

The first transistor 202 is the FET having predetermined temperature characteristics described above and shown in FIG. 1. The first FET 202 generates the reference voltage. The reference voltage generated across the first FET 202 is sampled by mean of an opamp 203 (operational amplifier) voltage follower. A load resistance 204 and second FET 206 convert the sampled reference voltage to current. A third FET 208 has a gate connected to the gate of the first FET 202. A fourth FET 210 and fifth FET 212 mirror the reference current, and feedback to the diode connected first FET 202, so that the proper reference voltage is maintained.

It can be seen that the reference current, $I_{ref}$, is $$I_{ref} = \frac{vgs_{ref}}{R_{ref}} \tag{9}$$

which is, for the first order, independent of supply voltage.

The key to the design is the generated reference voltage. In circumstances where the load resistance 204 remain constant over temperature, the first FET 202 is fabricated so that the reference voltage remains more or less constant over temperature.

Alternately, when the load resistance has a temperature coefficient, the first FET is fabricated so that the gate-to-source voltage has a corresponding temperature coefficient. In this manner, the reference current remains constant.

More specifically, the first FET 202 is an N-channel device with a gate connected its drain. The operational amplifier 203 has a positive input connected to the drain of the first FET 202 and a negative input connected to the load resistor 204. The second FET 206 is an N-channel device having a gate connected to the operational amplifier 203 output and a source connected to the load resistor 204.

The third FET 208 is an N-channel device having a gate connected to the gate of the first FET 202 to form a first current mirror. The fourth FET 210 is a P-channel device having a drain connected to the drain of the first FET 202. The fifth FET 212 is a P-channel device having a gate connected to the gate of the fourth FET 210, its own drain, and the drain of the second FET 206 to supply a bias voltage.

Also included are a first voltage source and a second voltage source at a lower potential than the first voltage source. A sixth FET 214 is a P-channel device having a drain connected to the first voltage source, a source connected to the positive input of the operational amplifier 203, and a gate connected to the drain of the third FET 208. A seventh FET 216 is a P-channel device having a source connected to the first voltage source and a gate connected to its own source and to the gate of the sixth FET 214. The load resistor 204 is has a second input connected to the second voltage source, as are the sources of the first and third FETs 202/208. The sources of the fourth and fifth FETs 210/121 are connected to the first voltage source.

As mentioned in the explanation of FIG. 1, the gate width and channel length can be selected so that the first FET 202 drain current remains approximately constant across the first temperature range. This feature is useful when the load resistance remains constant over temperature. That is, the first FET 202 channel length and the gate width are selected to create a gate-to-source voltage having a zero temperature coefficient. As mentioned above, the first FET 202 channel length and gate width are selected to create a gate-to-source voltage with a zero temperature coefficient at the first temperature.

Alternately, the load resistor 204 has a predetermined temperature coefficient. In some aspects of the invention, the load resistor can be replaced with an active load (not shown). Then, the first FET 202 gate-to-source voltage has a temperature coefficient that substantially matches the load resistor 204 temperature coefficient. The channel length and the gate width are selected so that their effects create the desired gate-to-source voltage temperature coefficient.

Figure 3:
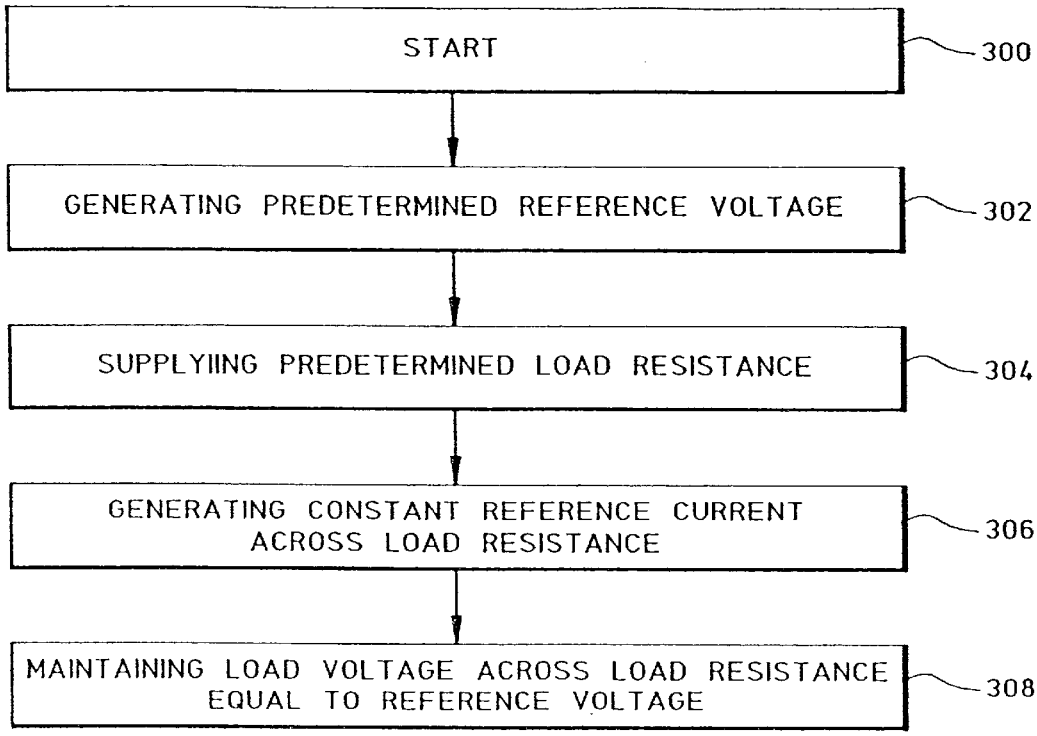
FIG. 3 is a flowchart illustrating the method for generating a predetermined bias voltage.

FIG. 3 is a flowchart illustrating the method for generating a predetermined bias voltage. Although the method is depicted as a sequence of numbered steps for clarity, no order should be inferred from the numbering unless explicitly stated. Step 300 is the start. Step 302 generates a predetermined reference voltage across a field effect transistor. Step 304 supplies a predetermined load resistance. Step 306 generates a substantially constant reference current across a load resistance, in response to the reference voltage.

In some aspects of the invention, an operational amplifier is included. Then, Step 302 generates the constant reference current using the operational amplifier to supply the reference current.

In some aspects, generating the constant reference current in Step 306 includes configuring the operational amplifier as a voltage follower. Then, Step 308 maintains a load voltage across the load resistance that is equal to the reference voltage.

In some aspects of the invention, supplying a load resistance in Step 308 includes supplying a load resistance with a first temperature coefficient across the first temperature range. Then, generating a predetermined reference voltage across a field effect transistor in Step 302 includes generating a reference voltage having the first temperature coefficient in the first temperature range.

In some aspects of the invention, generating a predetermined reference voltage across a field effect transistor in Step 302 includes selecting the channel length and the gate width to create the reference voltage first temperature coefficient.

In some aspects of the invention, generating a predetermined reference voltage across a field effect transistor in Step 302 includes generating a reference voltage that is substantially constant across a first range of temperatures.

In some aspects of the invention, generating a predetermined reference voltage across a field effect transistor in Step 302 includes generating a reference voltage that is substantially constant in the first temperature range of −40 to +130 degrees C.

In some aspects, an FET is included with a source and a drain, a gate having a first gate width (W), a first channel region having a first channel length (L) underlying the gate, between the source and drain. Then, generating a predetermined reference voltage across a field effect transistor in Step 302 includes selecting the first channel length and the first gate width to supply the predetermined reference voltage in the first temperature range.

In some aspects of the invention, generating a predetermined reference voltage across a field effect transistor in Step 302 includes expressing the relationship between the drain current, channel length, and gate width as described in detail above, for Equation 1.

In some aspects of the invention, generating a constant reference current in Step 306 includes determining the FET drain current at a first temperature ($T_{1st}$), approximately midway in the first range of temperatures.

In some aspects of the invention, generating a predetermined reference voltage across a field effect transistor in Step 302 includes generating a reference voltage that remains approximately constant across the first temperature range.

In some aspects of the invention, generating a constant reference current in Step 306 includes selecting the channel length and the gate width to create a FET gate-to-source voltage that remains approximately constant across the first temperature range.

In some aspects of the invention, generating a predetermined reference voltage across a field effect transistor in Step 302 includes selecting the channel length and gate width to create a gate-to-source voltage having a zero temperature coefficient at the first temperature.

In some aspects of the invention, generating a predetermined reference voltage across a field effect transistor in Step 302 includes selecting the channel length and the gate width from the expressions detailed above as Equations 2, 3, 5, 4, 6, and 7.

In some aspects of the invention, generating a predetermined reference voltage across a field effect transistor in Step 302 includes setting the temperature derivative of the gate to source voltage, at $T=T_{1st}$, equal to zero as described in detail at Equation 8.

In some aspects of the invention, generating a predetermined reference voltage across a field effect transistor in Step 302 includes the condition for the temperature stability at $T_{1st}$ as described in detail at Equation 9.

Figure 4:
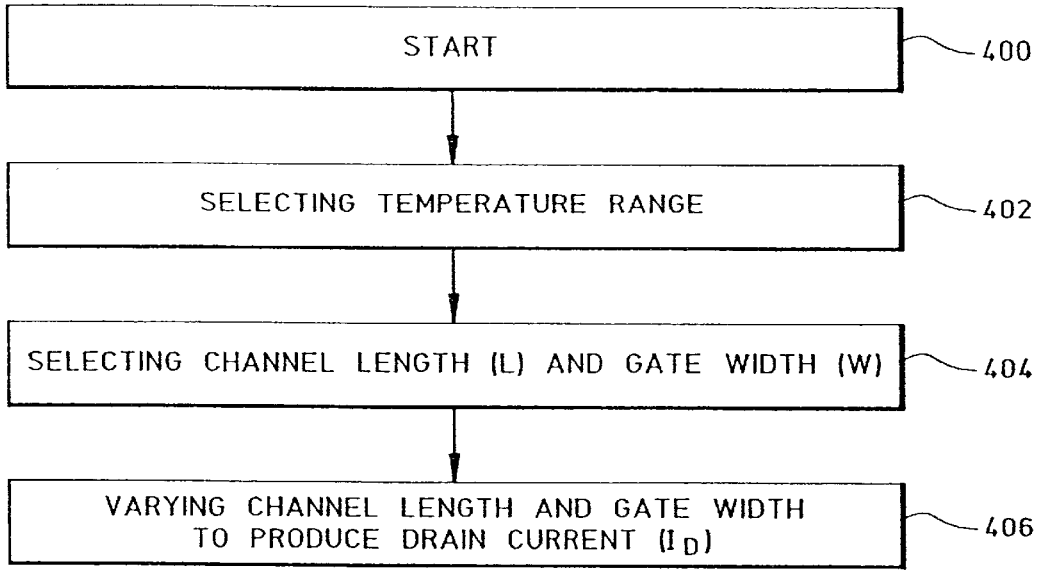
FIG. 4 is a flowchart demonstrating a method for fabricating a field effect transistor (FET), with predetermined temperature characteristics, having a source, a drain, a channel length between the source and drain, and a gate with a gate width.

FIG. 4 is a flowchart demonstrating a method for fabricating a field effect transistor (FET), with predetermined temperature characteristics, having a source, a drain, a channel length between the source and drain, and a gate with a gate width. The method begins at Step 400. Step 402 selects a temperature range. Step 404 selects a channel length (L) and a gate width (W). Step 406 varies the channel length and gate width to produce a drain current ($I_D$) with predetermined temperature characteristics across the temperature range.

In some aspects of the invention, varying the channel length and gate width to produce a drain current with predetermined temperature characteristics across the temperature range in Step 406 includes selecting the channel length and gate width to produce a drain current that is substantially constant across the temperature range.

In some aspects of the invention, varying the channel length and gate width to produce a drain current with predetermined temperature characteristics across the temperature range in Step 406 includes producing a drain current that is substantially constant in a temperature range of −40 to +130 degrees C.

In some aspects of the invention, varying the channel length and gate width to produce a drain current with predetermined temperature characteristics across the temperature range in Step 406 includes selecting the channel length and gate width to produce a drain current with a first temperature coefficient across the temperature range.

In some aspects of the invention, varying the channel length and gate width to produce a drain current with predetermined temperature characteristics across the temperature range in Step 406 includes producing a drain current with the relationship between the drain current, channel length, and gate width as expressed in detail above at Equation 2.

In some aspects of the invention, varying the channel length and gate width to produce a drain current with predetermined temperature characteristics across the temperature range in Step 406 includes determining the drain current at a first temperature ($T_{1st}$), approximately midway in the first range of temperatures.

In some aspects of the invention, varying the channel length and gate width to produce a drain current with predetermined temperature characteristics across the temperature range in Step 406 includes selecting the channel length and gate width so that their effects cancel the gate-to-source temperature coefficient at the first temperature.

In some aspects of the invention, varying the channel length and gate width to produce a drain current with predetermined temperature characteristics across the temperature range in Step 406 includes selecting the channel length and the gate width from the expressions described in detail at Equations 3, 5, 4, 6, and 7.

In some aspects of the invention, varying the channel length and gate width to produce a drain current with predetermined temperature characteristics across the temperature range in Step 406 includes setting the temperature derivative of the gate-to-source voltage, at $T=T_{1st}$, equal to zero as described in detail at Equation 8.

In some aspects of the invention, varying the channel length and gate width to produce a drain current with predetermined temperature characteristics across the temperature range In Step 406 includes the condition for the temperature stability as described in detail at Equation 9.

A FET with predetermined temperature characteristics, and constant output bias circuit have been provided. Although details have been provided for a long channel device, the present invention concepts apply equally well to short channel device, using the standard simulation models. A specific example has also been provided of a bias circuit using the above-mentioned FET. It should be understood that there are many other bias circuit configurations in which the FET can be utilized. Such bias circuits are not dependent on whether the FET is an N-channel or P-channel device. Further, such a bias circuit could be designed using combinations of FETs and bipolar devices. The critical aspect of such a bias circuit is that the FET with predetermined temperature characteristics is used as a voltage or current reference. Other variations and embodiments of the invention will occur to those skilled in the art.

What is claimed is:

1. A bias circuit comprising:

an operational amplifier having a negative input, a positive input, and an output;

a load resistor having resistor temperature coefficient;

a first N-channel field effect transistor having a source, and having a drain and a gate connected together and to the positive input, the first N-channel field effect transistor configured to provide, in accordance with a transistor temperature coefficient, a reference voltage to the positive input;

a second N-channel field effect transistor having a source connected to the negative input and the load resistor, a drain, and a gate connected to the output, the second N-channel field effect transistor configured to provide a bias voltage based on an output voltage produced at the output of the operational amplifier and in accordance with a relationship between the transistor temperature coefficient and the resistor temperature coefficient such that the bias voltage is independent of temperature for temperatures within a temperature range;

a current mirror responsive to a voltage for providing a current to the drain of the first N-channel field effect transistor and to the drain of the second N-channel field effect transistor;

the operational amplifier for comparing the reference voltage to a load voltage produced across the load resistor and adjusting the reference current to minimize a difference between the reference voltage and a load voltage produced across the load resistor;

a P-channel field effect transistor having a source for receiving the voltage, and having a drain and gate connected together;

a third N-channel field effect transistor having a drain connected to the drain and gate of the P-channel field effect transistor, having a gate connected to the drain and gate of the first N-channel field effect transistor, and having a source;

a fourth N-channel field effect transistor having a drain for receiving the voltage, having a gate connected to the drain and gate of the P-channel field effect transistor, and having a source connected to the positive input and to the drain and gate of the first N-channel field effect transistor; and the sources of the first and third N-channel field effect transistors being connected together and to the load resistor.

2. A bias circuit in accordance with claim 1, wherein the temperature range is from −40 degrees Celsius to +130 degrees Celsius.

* * * * *